US009377719B2

(12) United States Patent
Inaba et al.

(10) Patent No.: US 9,377,719 B2
(45) Date of Patent: Jun. 28, 2016

(54) DEVELOPING DEVICE AND IMAGE FORMING APPARATUS

(71) Applicant: FUJI XEROX CO., LTD., Minato-ku, Tokyo (JP)

(72) Inventors: Shigeru Inaba, Kanagawa (JP); Shigemi Murata, Kanagawa (JP); Yoshitaka Nakajima, Kanagawa (JP); Shinji Okuyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/494,821

(22) Filed: Sep. 24, 2014

(65) Prior Publication Data

US 2015/0277292 A1 Oct. 1, 2015

(30) Foreign Application Priority Data

Mar. 28, 2014 (JP) ..... 2014-069026

(51) Int. Cl.
*G03G 15/08* (2006.01)

(52) U.S. Cl.
CPC ..... *G03G 15/0891* (2013.01); *G03G 15/0893* (2013.01)

(58) Field of Classification Search
CPC ..... G03G 15/0891; G03G 15/0865; G03G 21/1676; G03G 21/1647; G03G 15/757; G03G 15/0893
USPC ..... 399/167, 119, 222, 252, 253, 254, 256, 399/258
See application file for complete search history.

(56) References Cited

U.S. PATENT DOCUMENTS

2010/0183341 A1* 7/2010 Ikeda ..... G06F 15/0822 399/255
2010/0322672 A1 12/2010 Murauchi et al.
2012/0070194 A1* 3/2012 Okuno ..... 399/254
2013/0078003 A1* 3/2013 Stelter ..... G03G 15/0893 399/254
2013/0202328 A1* 8/2013 Kimura ..... G03G 15/0877 399/258

FOREIGN PATENT DOCUMENTS

JP 5-83776 U 11/1993
JP 11-161020 A 6/1999
JP 3610750 A 1/2005
JP 2011-2760 A 1/2011
JP 2012133212 A * 7/2012

* cited by examiner

*Primary Examiner* — Francis Gray
(74) *Attorney, Agent, or Firm* — Sughrue Mion, PLLC

(57) ABSTRACT

A developing device includes a developer container; a developer carrier; a first transport member having a rotation shaft and a transport blade; a second transport member having a rotation shaft and a transport blade; a partition member; a guide member; a first inflow portion; a second inflow portion; and a movement portion. The rotation shaft of the first transport member is located within a projection area of the developer carrier projected from above. A second imaginary tangent line extending vertically and touching an outer end of the transport blade of the first transport member is farther from the image carrier than a first imaginary tangent line extending vertically and touching an outer surface of the developer carrier. A first distance between the first and second imaginary tangent lines is smaller than a second distance between a rotation center of the image carrier and an inner surface of the developer container.

6 Claims, 7 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2014-069026 filed Mar. 28, 2014.

BACKGROUND

Technical Field

The present invention relates to a developing device and an image forming apparatus.

SUMMARY

According to an aspect of the invention, there is provided a developing device including a developer container that stores developer; a developer carrier disposed in the developer container, the developer carrier being rotated, with the developer carried on a surface thereof, and facing an image carrier on which a latent image is formed; a first transport member that has a rotation shaft and a transport blade supported by the rotation shaft, the first transport member transporting the developer in the developer container while admixing the developer; a second transport member that has a rotation shaft and a transport blade supported by the rotation shaft, the second transport member being disposed parallel to the first transport member, the second transport member transporting the developer, while admixing the developer, in a direction opposite to a direction in which the first transport member transports the developer; a partition member disposed between the first transport member and the second transport member so as to partition a space inside the developer container into a first storage chamber where the first transport member is disposed and a second storage chamber where the second transport member is disposed; a guide member that guides the developer detached from the developer carrier toward the second storage chamber; a first inflow portion formed at a downstream end in the direction in which the first transport member transports the developer, the first inflow portion allowing the developer to flow from the first storage chamber toward the second storage chamber; a second inflow portion formed at a downstream end in a direction in which the second transport member transports the developer, the second inflow portion allowing the developer to flow from the second storage chamber toward the first storage chamber; and a movement portion provided in the partition member, at a position on an upstream side of the second inflow portion in the direction in which the second transport member transports the developer, the movement portion allowing the developer to move between the second storage chamber and the first storage chamber. The rotation shaft of the first transport member is located within a projection area of the developer carrier projected from above in a gravity direction. Assuming that there is a first imaginary tangent line extending in the gravity direction and touching an outer surface of the developer carrier, on the opposite side of the developer carrier from the image carrier, and that there is a second imaginary tangent line extending in the gravity direction and touching an outer end of the transport blade of the first transport member, on the opposite side of the first transport member from the image carrier, the second imaginary tangent line is located farther from the image carrier than the first imaginary tangent line in a horizontal direction. Assuming that a distance between the first imaginary tangent line and the second imaginary tangent line in the horizontal direction is a first distance and that a distance between a rotation center of the image carrier and an inner surface of the developer container in the horizontal direction, on the opposite side of the developer carrier from the image carrier, is a second distance, the first distance is smaller than the second distance.

BRIEF DESCRIPTION OF THE DRAWINGS

Exemplary embodiments of the present invention will be described in detail based on the following figures, wherein:

FIGS. 7A to 7D are diagrams for explaining the operation of a related-art developing device, wherein FIG. 7A is a sectional view of a configuration for returning developer to a supply chamber, FIG. 7B is a diagram for explaining the amount of developer and the intensity of developer in the configuration shown in FIG. 7A, FIG. 7C is a sectional view of a configuration for returning the developer to an admix chamber, and FIG. 7D is a diagram for explaining the amount of developer and the intensity of developer in the configuration shown in FIG. 7C;

DETAILED DESCRIPTION

Figure 1:
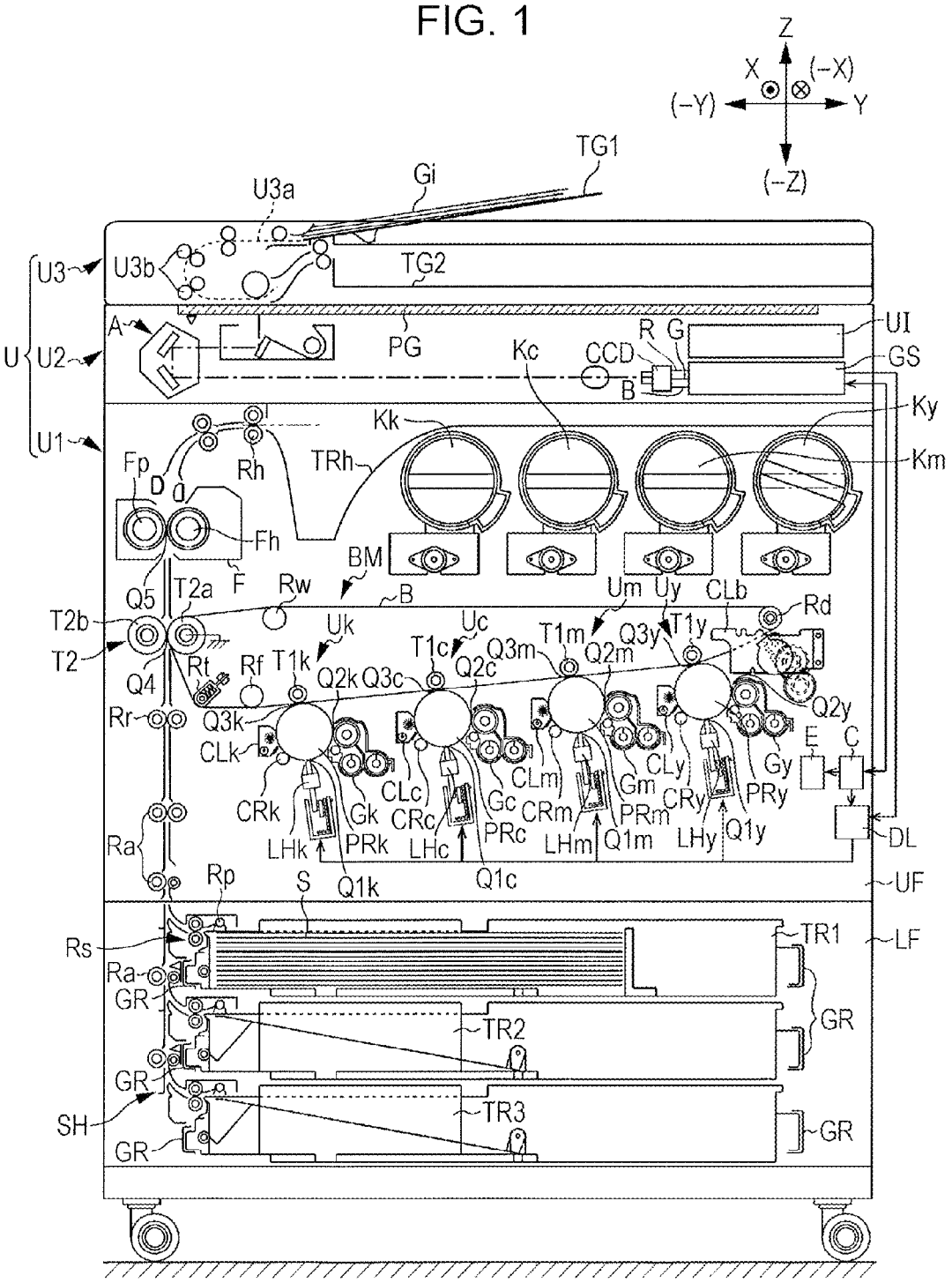
FIG. 1 is a diagram for explaining an image forming apparatus according to a first exemplary embodiment.

Referring to the drawings, exemplary embodiments of the present invention will be described below. Note that the present invention is not limited to the exemplary embodiments described below.

For ease of understanding the following description, in the drawings, the front-rear direction will be referred to as X-axis direction, the left-right direction will be referred to as Y-axis direction, and the top-bottom direction will be referred to as Z-axis direction. The directions or sides indicated by arrows X, −X, Y, −Y, Z, and −Z correspond to the front, rear, right, left, top, and bottom directions or sides, respectively.

Furthermore, in the drawings, a sign or a symbol formed of a circle and a dot (a dot is encircled by a circle) represents an arrow extending from the rear surface to the front surface of the sheet, and a sign or a symbol formed of a circle and a cross (a cross is encircled by a circle) represents an arrow extending from the front surface to the rear surface of the sheet.

For ease of understanding, members that need not be described in the following description are not shown in the drawings.

First Exemplary Embodiment

FIG. 1 is a diagram for explaining an image forming apparatus according to a first exemplary embodiment.

Figure 2:
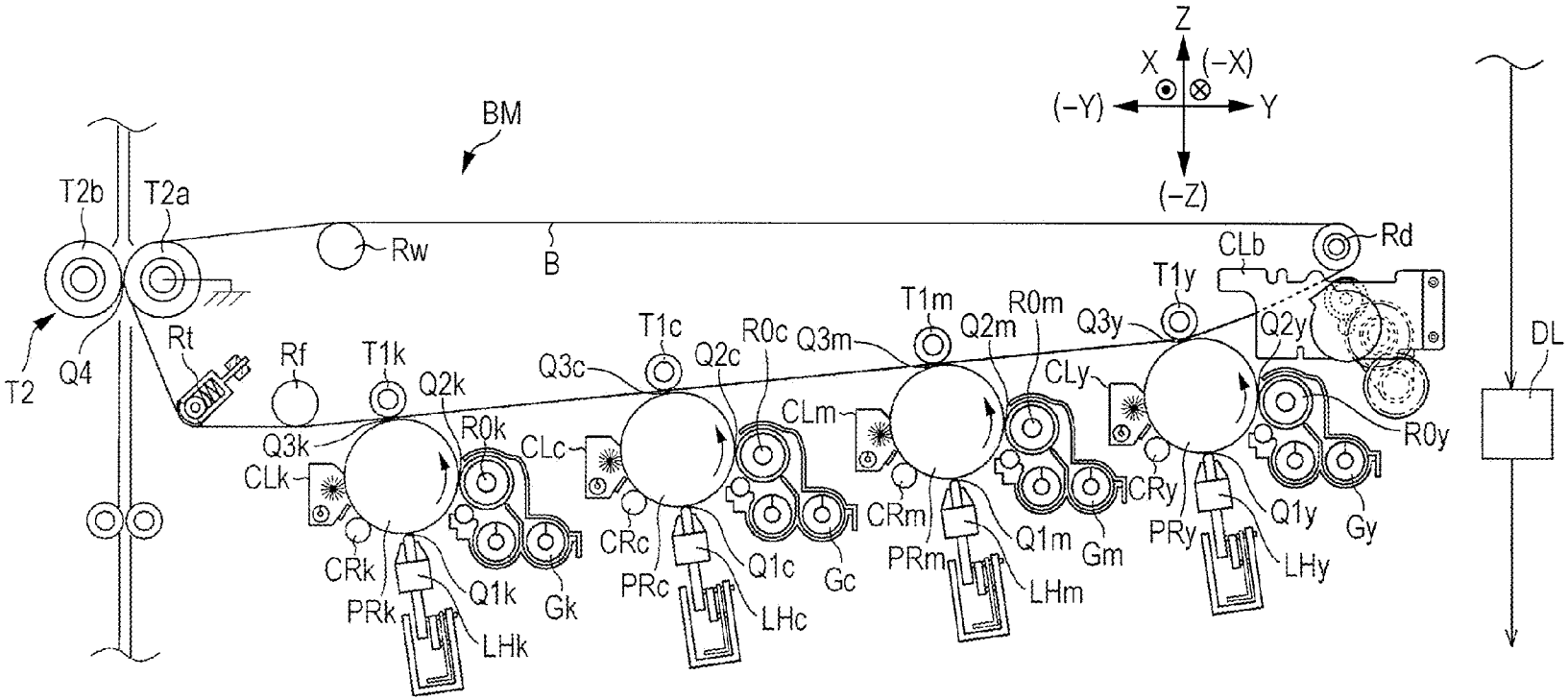
FIG. 2 is a diagram for explaining a relevant part of the image forming apparatus according to the first exemplary embodiment.

FIG. 2 is a diagram for explaining a relevant part of the image forming apparatus according to the first exemplary embodiment.

In FIG. 1, a copier U, serving as an example of an image forming apparatus according to the first exemplary embodiment of the present invention, includes a printer portion U1, serving as an example of a recording unit and an example of an image recording device. The printer portion U1 supports a scanner portion U2 disposed thereon, which serves as an example of a reading unit and an example of an image reading device. The scanner portion U2 supports an automatic feeder U3 disposed thereon, which serves as an example of a document transport device. The scanner portion U2 according to the first exemplary embodiment supports a user interface UI, serving as an example of an input portion. The user interface UI allows an operator to input a command to control the copier U.

A document tray TG1, serving as an example of a medium storage container, is disposed on the automatic feeder U3. The document tray TG1 holds a stack of documents Gi to be copied. A document output tray TG2, serving as an example of a document output portion, is formed below the document tray TG1. Document transport rollers U3*b* are disposed between the document tray TG1 and the document output tray TG2, along a document transport path U3*a*.

A platen glass PG, serving as an example of a transparent document bed, is disposed in the top surface of the scanner portion U2. In the scanner portion U2 according to the first exemplary embodiment, a reading optical system A is disposed below the platen glass PG. The reading optical system A according to the first exemplary embodiment is supported so as to be able to move in the left-right direction, along the lower surface of the platen glass PG. The reading optical system A is usually stationary at an initial position shown in FIG. 1.

An imaging device CCD, serving as an example of an imaging member, is disposed to the right of the reading optical system A. An image processing portion GS is electrically connected to the imaging device CCD.

The image processing portion GS is electrically connected to a writing circuit DL of the printer portion U1. The writing circuit DL is electrically connected to LED heads LHy, LHm, LHc, and LHk, serving as an example of a latent image forming device.

Photoconductor drums PRy, PRm, PRc, and PRk, serving as an example of an image carrier, are disposed above the LED heads LHy to LHk.

Charging rollers CRy, CRm, CRc, and CRk, serving as an example of a charger, are disposed so as to face the photoconductor drums PRy to PRk. A power supply circuit E applies a charging voltage to the charging rollers CRy to CRk. The power supply circuit E is controlled by a controller C, serving as an example of a controller. The controller C transmits signals to and receives signals from the image processing portion GS, the writing circuit DL, etc. to perform various types of control.

The LED heads LHy to LHk radiate writing light to the surfaces of the photoconductor drums PRy to PRk, more specifically, to writing areas Q1*y*, Q1*m*, Q1*c*, and Q1*k* designated on the downstream side of the charging rollers CRy to CRk in the rotation direction of the photoconductor drums PRy to PRk.

Developing devices Gy, Gm, Gc, and Gk are disposed so as to face the surfaces of the photoconductor drums PRy to PRk, in developing areas Q2*y*, Q2*m*, Q2*c*, and Q2*k* designated on the downstream side of the writing areas Q1*y* to Q1*k* in the rotation direction of the photoconductor drums PRy to PRk.

First transfer areas Q3*y*, Q3*m*, Q3*c*, and Q3*k* are designated on the downstream side of the developing areas Q2*y* to Q2*k* in the rotation direction of the photoconductor drums PRy to PRk. The photoconductor drums PRy to PRk are in contact with an intermediate transfer belt B, serving as an example of an intermediate transfer body, in the first transfer areas Q3*y* to Q3*k*. Furthermore, in the first transfer areas Q3*y*, Q3*m*, Q3*c*, and Q3*k*, first transfer rollers T1*y*, T1*m*, T1*c*, and T1*k*, serving as an example of a first transfer member, are disposed so as to face the photoconductor drums PRy to PRk, with the intermediate transfer belt B therebetween.

Drum cleaners CLy, CLm, CLc, and CLk, serving as an example of an image-carrier cleaner, are disposed on the downstream side of the first transfer areas Q3*y* to Q3*k* in the rotation direction of the photoconductor drums PRy to PRk.

A belt module BM, serving as an example of an intermediate transfer device, is disposed above the photoconductor drums PRy to PRk. The belt module BM includes the intermediate transfer belt B. The intermediate transfer belt B is supported, in a rotatable manner, by a driving roller Rd, serving as an example of a driving member; a tension roller Rt, serving as an example of a tension member; a walking roller Rw, serving as an example of a meandering correcting member; an idler roller Rf, serving as an example of a driven member; a back-up roller T2*a*, serving as an example of an opposing member in a second transfer area; and the first transfer rollers T1*y*, T1*m*, T1*c*, and T1*k*.

A second transfer roller T2*b*, serving as an example of a second transfer member, is disposed so as to face the back-up roller T2*a* with the intermediate transfer belt B therebetween. The back-up roller T2*a* and the second transfer roller T2*b* together form a second transfer member T2. Furthermore, a second transfer area Q4 is formed at an area where the second transfer roller T2*b* and the intermediate transfer belt B face each other.

The first transfer rollers T1*y* to T1*k*, the intermediate transfer belt B, and the second transfer member T2 together form a transfer device T1+T2+B according to the first exemplary embodiment, which transfers images formed on the photoconductor drums PRy to PRk to a medium.

A belt cleaner CLb, serving as an example of an intermediate-transfer-body cleaner, is disposed on the downstream side of the second transfer area Q4 in the rotation direction of the intermediate transfer belt B.

Cartridges Ky, Km, Kc, and Kk, serving as an example of a developer storage container, are disposed above the belt module BM. The cartridges Ky to Kk store developer to be supplied to the developing devices Gy to Gk. The cartridges Ky to Kk and the developing devices Gy to Gk are connected to each other via developer supply devices (not shown).

Paper feed trays TR1 to TR3, serving as an example of a medium storage container, are disposed below the printer portion U1. The paper feed trays TR1 to TR3 are supported by guide rails GR, serving as an example of a guide member, such that they are attached to or removed from the printer portion U1 in the front-rear direction. The paper feed trays TR1 to TR3 accommodate sheets S, serving as an example of media.

A pick-up roller Rp, serving as an example of a medium pick-up member, is disposed to the upper left of each of the paper feed trays TR1 to TR3. A separating roller Rs, serving as an example of a separating member, is disposed to the left of the pick-up roller Rp.

A medium transport path SH extending upward is formed to the left of the paper feed trays TR1 to TR3. Multiple transport rollers Ra, serving as an example of a medium transport member, are disposed along the transport path SH. A register roller Rr, serving as an example of a feeding member, is disposed in the transport path SH, at a position on the downstream side in the sheet-transport direction and on the upstream side of the second transfer area Q4.

A fixing device F is disposed above the second transfer area Q4. The fixing device F includes a heating roller Fh, serving as an example of a heating member, and a pressure roller Fp, serving as an example of a pressure member. A contact area between the heating roller Fh and the pressure roller Fp constitutes a fixing area Q5.

A discharge roller Rh, serving as an example of a medium transport member, is disposed to the upper light of the fixing device F. An output tray TRh, serving as an example of a medium output portion, is formed to the right of the discharge roller Rh.

Image Forming Operation

Multiple documents Gi stored on the document tray TG1 sequentially pass through a document reading position on the platen glass PG and are discharged on the document output tray TG2.

When a copying operation is performed by using the automatic feeder U3 that automatically transports the documents, the documents Gi sequentially passing through the reading position on the platen glass PG are exposed to light by the reading optical system A stationarily disposed at an initial position.

When a copying operation is performed by an operator who places the documents Gi on the platen glass PG by hand, the document on the platen glass PG is scanned, while being exposed to the light, by the reading optical system A moving in the left-right direction.

The reflected light from the document Gi passes through the reading optical system A and is collected by the imaging device CCD. The imaging device CCD converts the reflected light from the document Gi, collected on an imaging surface thereof, into electric signals corresponding to red (R), green (G), and blue (B).

The image processing portion GS converts the RGB electric signals, input from the imaging device CCD, into image information corresponding to black (K), yellow (Y), magenta (M), and cyan (C) and temporarily stores the information. The image processing portion GS then outputs the temporarily stored image information to the writing circuit DL at predetermined timing, so that the image information is used to form latent images.

When a document image is a single-color image, i.e., a monochrome image, image information corresponding to only black (K) is input to the writing circuit DL.

The writing circuit DL has driving circuits (not shown) for Y, M, C, and K and outputs signals corresponding to the image information inputted thereto to the LED heads LHy to LHk for the respective colors at predetermined timing.

The surfaces of the photoconductor drums PRy to PRk are charged by the charging rollers CRy to CRk. The LED heads LHy to LHk form electrostatic latent images on the surfaces of the photoconductor drums PRy to PRk in the writing areas Q1*y* to Q1*k*. The developing devices Gy to Gk develop the electrostatic latent images on the surfaces of the photoconductor drums PRy to PRk into toner images, serving as an example of a visible image, in the developing areas Q2*y* to Q2*k*. When the developing devices Gy to Gk consume the developer, the cartridges Ky to Kk supply the developer to the developing devices Gy to Gk, according to the amount consumed.

The toner images on the surfaces of the photoconductor drums PRy to PRk are transported to the first transfer areas Q3*y*, Q3*m*, Q3*c*, and Q3*k*. A first transfer voltage having the opposite polarity to the toner is applied from a power supply circuit E to the first transfer rollers T1*y* to T1*k* at predetermined timing. As a result, the toner images on the photoconductor drums PRy to PRk are sequentially transferred, in a superposed manner, to the intermediate transfer belt B in the first transfer areas Q3*y* to Q3*k* due to the first transfer voltage. Note that, when a black image is to be formed, only a black toner image is transferred from the photoconductor drum PRk to the intermediate transfer belt B.

The toner images on the photoconductor drums PRy to PRk are first-transferred to the intermediate transfer belt B, serving as an example of an intermediate transfer body, by the first transfer rollers T1*y*, T1*m*, T1*c*, and T1*k*. Residues and deposits remaining on the surfaces of the photoconductor drums PRy to PRk after the first transfer are cleaned by the photoconductor cleaners CLy to CLk. The cleaned surfaces of the photoconductor drums PRy to PRk are charged again by the charging rollers CRy to CRk.

A sheet S stored in the paper feed tray TR1, TR2, or TR3 is picked up by the pick-up roller Rp at predetermined paper feed timing. When the pick-up roller Rp picks up several sheets S at a time, the separating roller Rs separates the sheets S into individual sheets S. The sheet S having passed through the separating roller Rs is transported to the register roller Rr by the multiple transport rollers Ra.

The register roller Rr feeds the sheet S in accordance with the timing at which the toner image on the surface of the intermediate transfer belt B is transported to the second transfer area Q4.

When the sheet S fed by the register roller Rr passes through the second transfer area Q4, the toner image on the surface of the intermediate transfer belt B is transferred the sheet S, due to a second transfer voltage applied to the second transfer roller T2*b*.

The surface of the intermediate transfer belt B after passing through the second transfer area Q4 is cleaned by the belt cleaner CLb to remove the residual toner.

The sheet S having passed through the second transfer area Q4 is heated and pressed by the fixing device F as it passes through the fixing area Q5. Thus, the toner image on the sheet S is fixed to the sheet S.

The recording sheet S to which the toner image has been fixed is discharged onto the output tray TRh by the discharge roller Rh.

Developing Device

Figure 3:
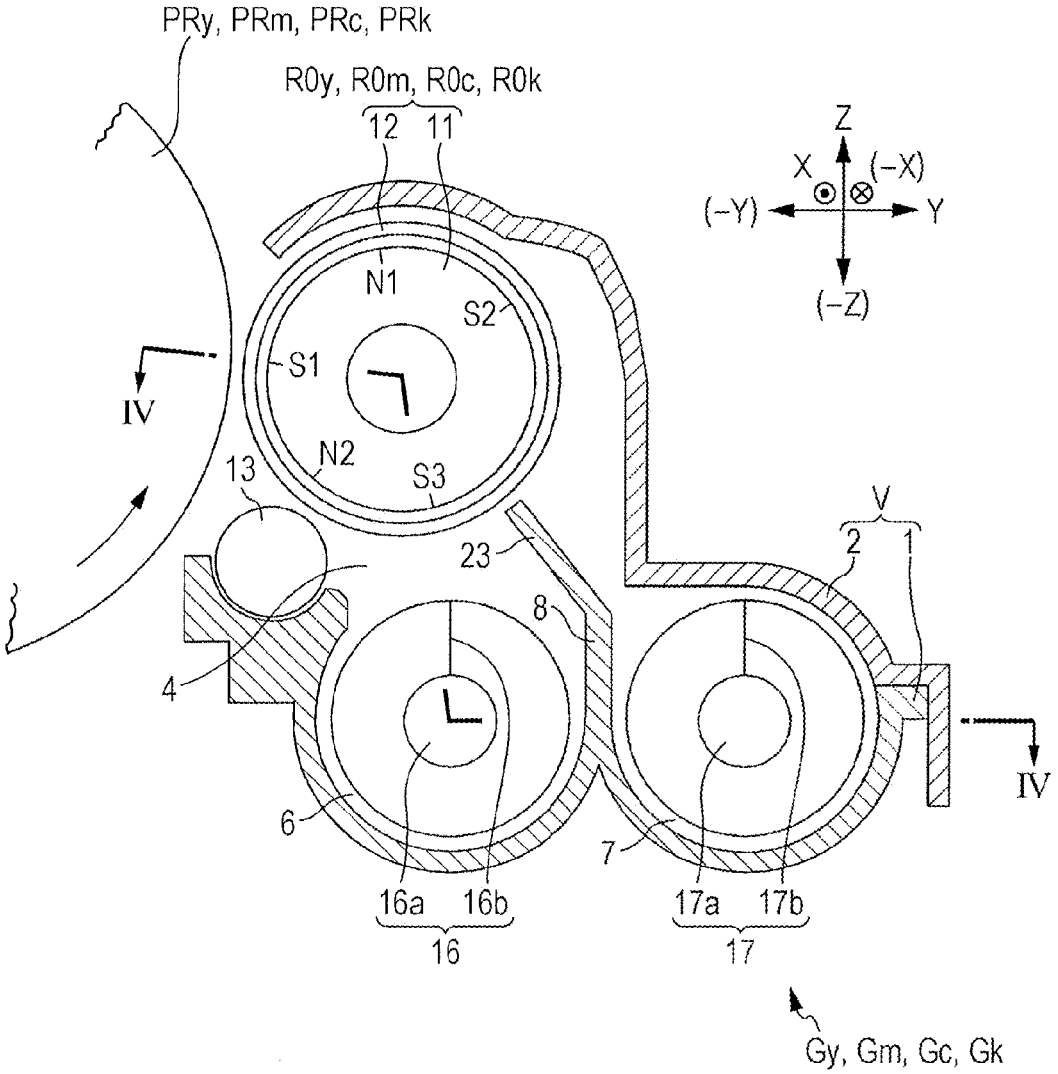
FIG. 3 is a diagram for explaining a developing device according to the first exemplary embodiment.

FIG. 3 is a diagram for explaining the developing device according to the first exemplary embodiment.

Figure 4:
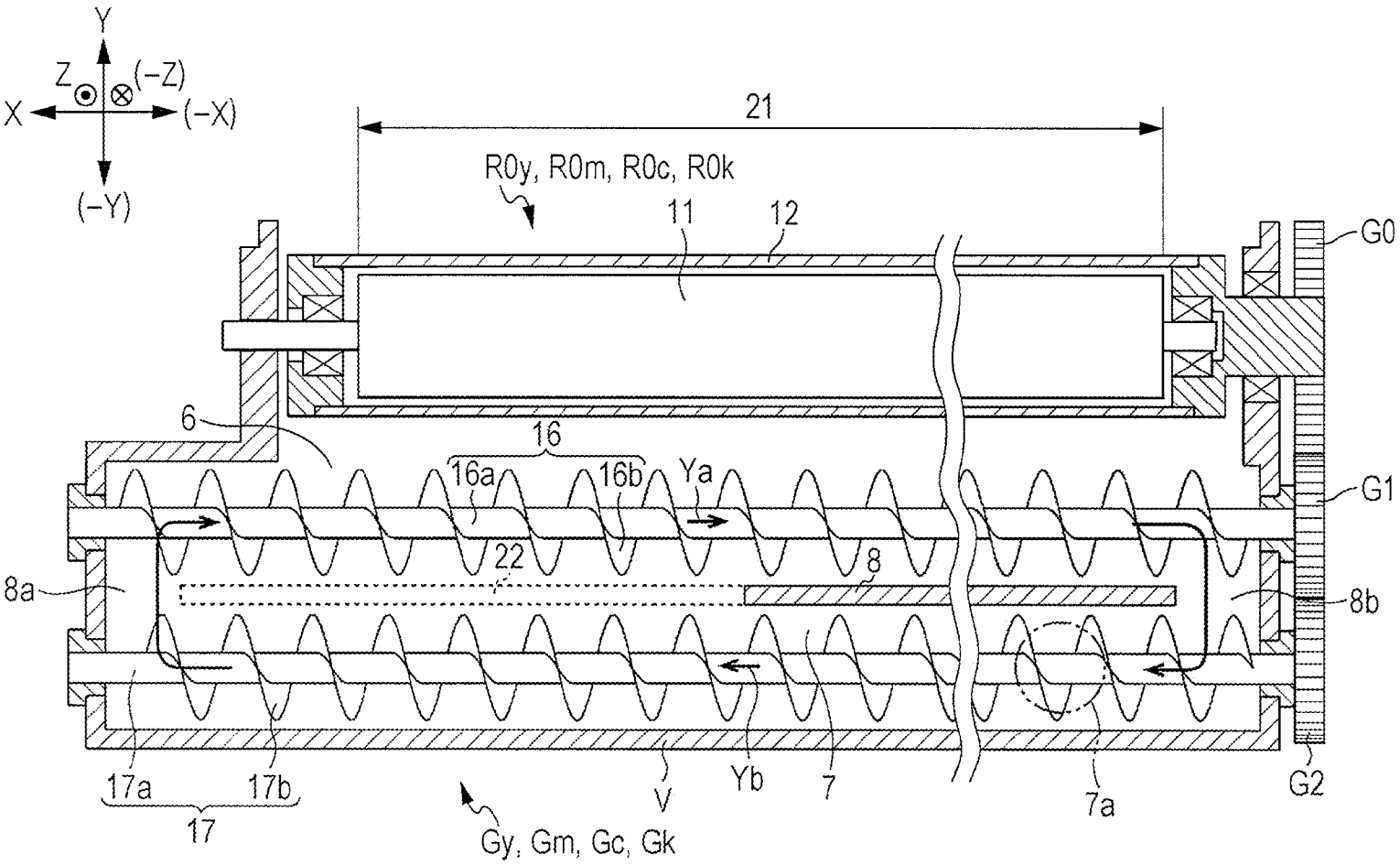
FIG. 4 is a sectional view taken along line IV-IV in FIG. 3.

FIG. 4 is a sectional view taken along line IV-IV in FIG. 3.

Next, the developing devices Gy, Gm, Gc, and Gk according to the first exemplary embodiment of the present invention will be described. Because the developing devices Gy, Gm, Gc, and Gk for the respective colors have the same configuration, only the developing device Gy for yellow (Y) will be described in detail below, while omitting a detailed description of the developing devices Gm, Gc, and Gk for the other colors.

In FIGS. 3 and 4, the developing device Gy disposed so as to face the photoconductor drum PRy includes a developer container V that stores two-component developer composed of toner and carrier. In FIG. 3, the developer container V includes a container body 1 constituting a lower part of the developer container V. The container body 1 supports a container cover 2, serving as an example of a lid member, provided thereon. The container cover 2 closes the top surface of the container body 1.

In FIGS. 3 and 4, the container body 1 has a developing roller chamber 4, serving as an example of a developer-carrier storing portion, formed at the upper left part thereof. A supply chamber 6, serving as an example of a first storage chamber, is formed below the developing roller chamber 4. The supply chamber 6 and the developing roller chamber 4 are connected to each other. An admix chamber 7, serving as an example of a second storage chamber, is formed to the right of the supply chamber 6.

The supply chamber 6 and the admix chamber 7 are separated from each other by a partition wall 8, serving as an example of a partition member. In FIG. 4, a first inflow portion 8*a*, serving as an example of a first connecting portion, connecting between the supply chamber 6 and the admix chamber 7 is formed in front of the partition wall 8. In the first exemplary embodiment, the first inflow portion 8*a* is disposed in front of the front end of the developing roller chamber 4. Furthermore, a second inflow portion 8*b*, serving as an example of a second connecting portion, connecting between the supply chamber 6 and the admix chamber 7 is formed behind the partition wall 8.

The developing roller chamber 4 accommodates a developing roller R0*y*, serving as an example of a developer carrier. The developing roller R0*y* is disposed such that an upper left portion of the outer surface thereof faces the photoconductor drum PRy. The developing roller R0*y* includes a magnet roller 11, serving as an example of a magnet member. In FIG. 4, the magnet roller 11 is supported by the developer container V in a non-rotatable manner. In FIGS. 3 and 4, a developing sleeve 12, serving as an example of a rotary member, is disposed around the magnet roller 11. The developing sleeve 12 is supported by the developer container V so as to be rotatable. A gear G0, serving as an example of a driving-force transmission member, is supported at the rear end of the developing sleeve 12. A motor (not shown), serving as an example of a driving force source, transmits a driving force to the gear G0. In the developing device Gy according to the first exemplary embodiment, when a driving force from the motor is transmitted, the developing sleeve 12 is rotated in the same direction as the surface of the photoconductor drum PRy, in the developing area Q2*y*.

A trimmer 13, serving as an example of a layer-thickness restriction member, is disposed below the developing roller chamber 4. The trimmer 13 according to the first exemplary embodiment has a cylindrical shape extending in the front-rear direction. The trimmer 13 is supported at a predetermined distance from the developing sleeve 12, in a non-rotatable manner.

The magnet roller 11 has a developing pole S1 corresponding to the developing area Q2*y*. The magnet roller 11 also has a trimming pole N2, serving as an example of a layer-thickness restricting pole, at a position facing the trimmer 13. The trimming pole N2 has the opposite polarity to the developing pole S1. Furthermore, a transport pole N1 having the opposite polarity to the developing pole S1 is provided on the downstream side of the developing pole S1 in the rotation direction of the developing sleeve 12. A pick-off pole S2, serving as an example of developer-detaching pole, is provided on the downstream side of the transport pole N1 in the rotation direction of the developing sleeve 12. The pick-off pole S2 has the opposite polarity to the transport pole N1. A pick-up pole S3, serving as an example of a developer pick-up pole, is provided on the downstream side of the pick-off pole S2 and on the upstream side of the trimming pole N2 in the rotation direction of the developing sleeve 12. The pick-up pole S3 has the same polarity as the pick-off pole S2 and the opposite polarity to the trimming pole N2.

In FIGS. 3 and 4, a supply auger 16, serving as an example of a first transport member, is disposed in the supply chamber 6. The supply auger 16 includes a rotation shaft 16*a* extending in the front-rear direction. The rotation shaft 16*a* supports a spiral transport blade 16*b* on the outer circumference thereof. Furthermore, the rotation shaft 16*a* supports a gear G1, serving as an example of a driving-force transmission member, at the rear end thereof.

An admix auger 17, serving as an example of a second transport member, is disposed in the admix chamber 7. The admix auger 17 includes a rotation shaft 17*a*, a transport blade 17*b*, and a gear G2, similarly to the supply auger 16. The gears G0 to G2 mesh with one another.

Furthermore, in FIG. 4, the admix chamber 7 is provided with a supply port 7*a* at the rear part thereof, through which the developer from the cartridge Ky is supplied.

Function of the Developing Device

In the thus-configured developing devices Gy to Gk, when an image forming operation is started, the motor is driven, rotating the augers 16 and 17 and the developing rollers R0*y* to R0*k*. In the first exemplary embodiment, when the supply auger 16 is rotated, the supply auger 16 transports, while admixing, the developer in the supply chamber 6 from the first inflow portion 8*a* to the second inflow portion 8*b*, as indicated by an arrow Ya. The developer transported to the second inflow portion 8*b* flows in the admix chamber 7 through the second inflow portion 8*b*. When the admix auger 17 is rotated, the admix auger 17 transports, while admixing, the developer in the admix chamber 7 from the second inflow portion 8*b* to the first inflow portion 8*a*, as indicated by an arrow Yb. The developer transported to the first inflow portion 8*a* flows in the supply chamber 6 through the first inflow portion 8*a*. In this manner, the supply chamber 6 and the admix chamber 7 together constitute a circulation chamber 6+7.

The developer in the supply chamber 6 is attracted to the developing sleeve 12 due to the magnetic force of the pick-up pole S3. The developer attracted to the developing sleeve 12 passes the trimmer 13. At this time, only predetermined developer corresponding to the space between the trimmer 13 and the developing sleeve 12 passes. After passing the trimmer 13, the developer develops latent images on the photoconductor drums PRy to PRk in the developing areas Q2*y* to Q2*k*. The developer that is not used to develop the latent images is transported, while being attracted to the surface of the developing sleeve 12 due to the magnetic field between the developing pole S1 and the transport pole N1 and the magnetic field between the transport pole N1 and the pick-off pole S2. A magnetic force that attracts the developer to the developing sleeve 12 is weak between the pick-off pole S2 and the pick-up pole S3, which have the same polarity. Hence, the developer attracted to the surface of the developing sleeve 12 is detached from the developing sleeve 12 at a position between the pick-off pole S2 and the pick-up pole S3 and is returned to the circulation chamber 6+7.

Components of the Developing Device

Figure 5:
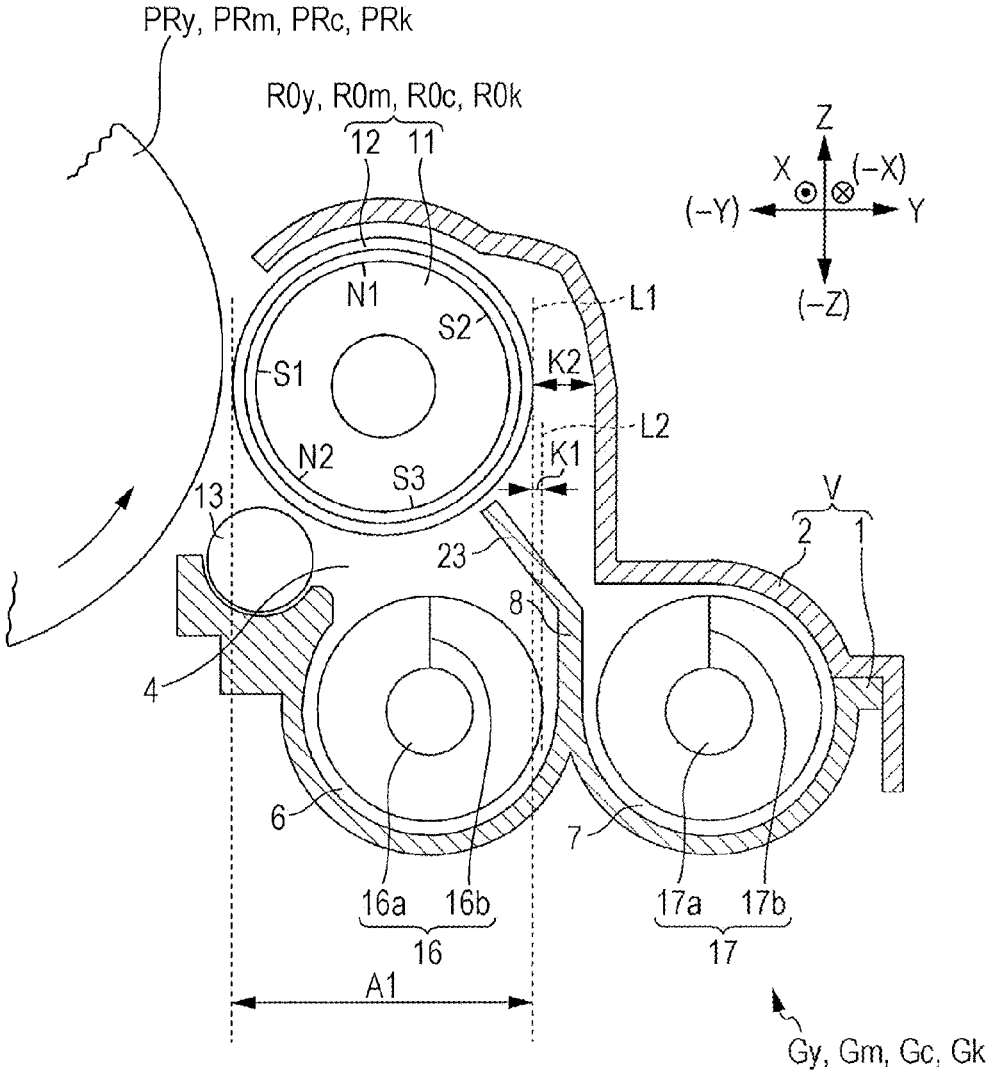
FIG. 5 is a diagram for explaining a positional relationship in the first exemplary embodiment and is a diagram corresponding to FIG. 3.

FIG. 5 is a diagram for explaining a positional relationship in the first exemplary embodiment and is a diagram corresponding to FIG. 3.

In FIG. 5, in the developing device Gy according to the first exemplary embodiment, the rotation shaft 16*a* of the supply auger 16 is disposed within a projection area, A1, of the developing roller R0*y*, projected from above in the gravity direction.

As shown in FIG. 5, a tangent line extending in the gravity direction and touching the outer surface of the developing roller R0*y*, on the opposite side of the developing roller R0*y* from the photoconductor drum PRy, is assumed to be a first imaginary tangent line L1. Furthermore, a tangent line extending in the gravity direction and touching the outer end of the transport blade 16*b* of the supply auger 16, on the opposite side of the supply auger 16 from the photoconductor drum PRy, is assumed to be a second imaginary tangent line L2. In the developing device Gy according to the first exemplary embodiment, the second imaginary tangent line L2 is located farther, in the horizontal direction, from the photoconductor drum PRy than the first imaginary tangent line L1.

As shown in FIG. 5, the distance between the first imaginary tangent line L1 and the second imaginary tangent line L2 in the horizontal direction is assumed to be a first distance K1. Furthermore, the distance between the surface of the developing roller R0*y* and the inner surface of the developer container V on the horizontal line extending from the rotation center of the developing roller R0*y* in the horizontal direction, on the opposite side of the developing roller R0*y* from the photoconductor drum PRy, is assumed to be a second distance K2. In the developing device Gy according to the first exemplary embodiment, the first distance K1 is smaller than the second distance K2.

Accordingly, in the developing device Gy according to the first exemplary embodiment, the developing roller R0*y* and the supply auger 16 are disposed substantially parallel to each other in the horizontal direction. Thus, the developing device Gy according to the first exemplary embodiment is smaller than the related-art developing device.

Partition Member

Figure 6:
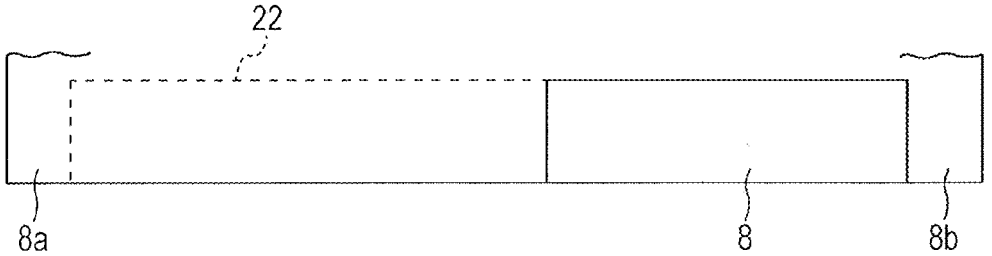
FIG. 6 is a diagram for explaining a partition wall according to the first exemplary embodiment.

FIG. 6 is a diagram for explaining a partition wall according to the first exemplary embodiment.

In FIG. 4, in the developing device Gy according to the first exemplary embodiment, the second inflow portion 8*b* is provided behind a developing width 21, which is an area, extending in the axial direction, of the developing roller R0*y* where a toner image is developed. In FIGS. 4 and 6, the partition wall 8 according to the first exemplary embodiment has a by-pass portion 22, serving as an example of a movement portion, in front of the second inflow portion 8*b*. The by-pass portion 22 according to the first exemplary embodiment is formed so as to be continuous with the front end of the second inflow portion 8*b*. In the first exemplary embodiment, the partition wall 8 is not provided in the by-pass portion 22. Thus, in the first exemplary embodiment, the developer moves between the supply chamber 6 and the admix chamber 7 through the by-pass portion 22.

The by-pass portion 22 according to the first exemplary embodiment extends to the middle of the developing width 21 in the front-rear direction. Hence, in the first exemplary embodiment, the developer is able to move between the supply chamber 6 and the admix chamber 7, in the upstream half area of the developing width 21 in the direction in which the supply auger 16 transports the developer. Note that the by-pass portion 22 does not necessarily have to extend to the middle of the developing width 21, as shown in this embodiment. Because it is desirable that the developer supplied from the supply port 7*a* reach the by-pass portion 22 in an admixed state, the length of the by-pass portion 22 may be determined within the range from, for example, one-fourth to three-fourth of the developing width 21.

In FIG. 3, in the developing device Gy according to the first exemplary embodiment, a guide wall 23, serving as an example of a guide member, is formed above the partition wall 8. The guide wall 23 is configured to guide the developer detached from a portion of the developing roller R0*y*, the portion between the pick-off pole S2 and the pick-up pole S3, toward the admix chamber 7. Hence, the upper end of the guide wall 23 is provided at a position corresponding to the position where the developer is detached from a portion of the developing roller R0*y*, the portion between the pick-off pole S2 and the pick-up pole S3. Furthermore, the lower end of the guide wall 23 extends to a position corresponding to the upper end of the partition wall 8. The guide wall 23 according to the first exemplary embodiment extends in the front-rear direction. Thus, the guide wall 23 is formed above the by-pass portion 22.

In the thus-configured developing device Gy according to the first exemplary embodiment, the developer detached from a portion of the developing sleeve 12, the portion between the pick-off pole S2 and the pick-up pole S3, is guided by the guide member 23 and returned to the admix chamber 7. The developer returned to the admix chamber 7 is transported while being admixed by the admix auger 17. Herein, the spiral transport blade 17*b* is provided at an angle with respect to the front-rear direction. Therefore, the developer transported by the admix auger 17 receives, from the spiral transport blade 17*b*, not only a force having a component directed in the front-rear direction, but also a force having a component directed toward the supply chamber 6. Accordingly, a portion of the developer in the admix chamber 7 moves to the supply chamber 6 through the by-pass portion 22.

Figure 7B:
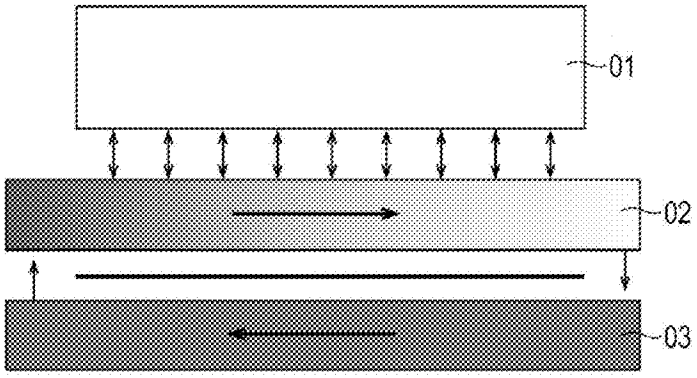
Figure 7D:
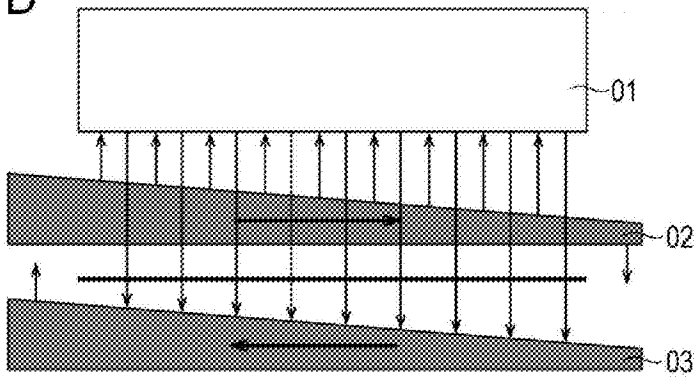
Figure 7A:
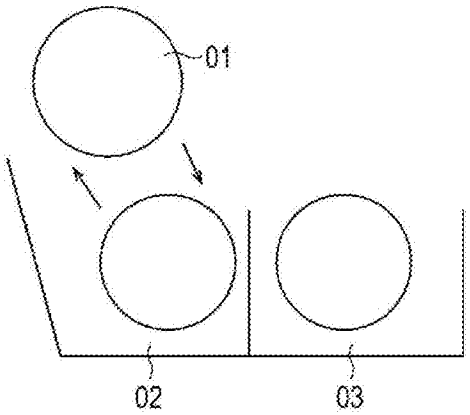
Figure 7C:
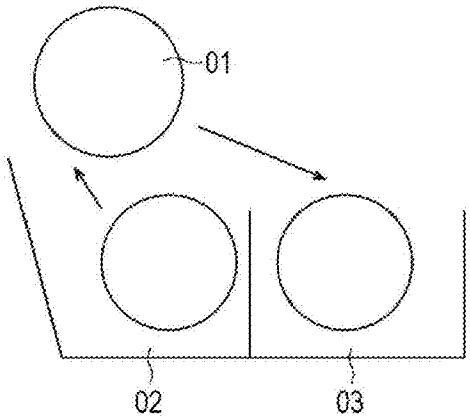

FIGS. 7A to 7D are diagrams for explaining the operation of a related-art developing device, wherein FIG. 7A is a sectional view of a configuration for returning developer to a supply chamber, FIG. 7B is a diagram for explaining the amount of developer and the intensity of developer in the configuration shown in FIG. 7A, FIG. 7C is a sectional view of a configuration for returning the developer to the admix chamber, and FIG. 7D is a diagram for explaining the amount of developer and the intensity of developer in the configuration shown in FIG. 7C.

In the related-art developing device that does not have the by-pass portion 22 or the guide member 23, as shown in FIG. 7A, developer detached from the developing roller 01 is returned to a supply chamber 02. In this configuration, the developer in the supply chamber 02 is picked up on the upstream side in a developer-transport direction, the toner is consumed in the developing area Q2*y*, and the developer is returned to the supply chamber 02. Then, the developer is picked up again, and the toner is further consumed in the developing area Q2*y*. The developer in the supply chamber 02 repeatedly goes through this process, so, the toner intensity in the developer decreases toward the downstream side, as shown in FIG. 7B. Consequently, an image developed on the downstream side in the developing width 21 may have insufficient intensity, or the intensity of an image may be different between the upstream portion and the downstream portion in the developing width 21. In particular, because the total amount of developer is small in a small developing device Gy, the influence of a decrease in intensity is relatively obvious.

Furthermore, in the related-art developing device, there is a configuration in which the developer detached from the developing roller 01 is returned to an admix chamber 03, as shown in FIG. 7C. In this configuration, the developer with reduced intensity due to the toner being used in the developing area Q2*y* is not returned to the supply chamber 02. Therefore, as shown in FIG. 7D, the toner intensity in the supply chamber 02 is less likely to decrease. However, because the developer, once picked up, is not returned to the supply chamber 02, the amount of developer in the supply chamber 02 gradually decreases toward the downstream side. Hence, the amount of developer in the supply chamber 02 may become insufficient on the downstream side. Meanwhile, because the developer picked off from the developing roller R0*y* flows into the admix chamber 03, the amount of developer in the admix chamber 03 becomes unevenly large on the downstream side.

When the amount of developer becomes unevenly large, the load (i.e., stress) applied to the developer when the admix auger 17 is rotated increases, resulting in a problem that deterioration of developer is likely to progresses. The deterioration of the developer may result in development defect. Furthermore, when the amount of developer becomes unevenly large, the rotation load of the admix auger 17 increases, which may lead to an increase in power consumption or a fault with the driving force source.

In particular, when the developing device is reduced in size, and, consequently, the total amount of developer is reduced, the influence of shortage of the developer and the influence of unevenness of developer become relatively large.

Figure 8:
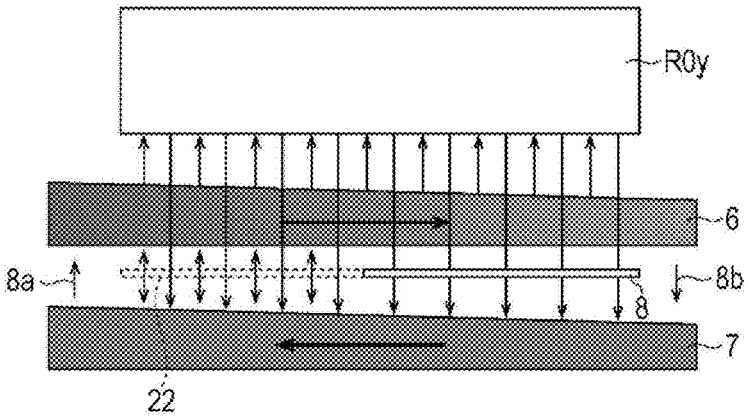
FIG. 8 is a diagram for explaining the amount of developer and the intensity of developer in the developing device according to the first exemplary embodiment.

FIG. 8 is a diagram for explaining the amount of developer and the intensity of developer in the developing device according to the first exemplary embodiment.

The developing device Gy according to the first exemplary embodiment is configured such that the developer detached from the developing roller R0*y* is returned to the admix chamber 7 and such that a portion of the developer is able to move to the supply chamber 6 through the by-pass portion 22 on the downstream side in the admix chamber 7. Therefore, as shown in FIG. 8, not only excess of the developer on the downstream side in the admix chamber 7, but also shortage of the developer in the supply chamber 6, is suppressed.

Furthermore, the developer flowing from the admix chamber 7 into the supply chamber 6 through the by-pass portion 22 is a mixture of the picked off, low-intensity developer and the relatively high-intensity developer transported from the upstream side in the admix chamber 7. Therefore, the intensity of the developer flowing into the supply chamber 6 through the by-pass portion 22 is higher than that of the configuration shown in FIGS. 7A and 7B. Thus, a decrease in intensity of developer occurring on the downstream side of the supply chamber 6 is reduced compared with the configuration shown in FIGS. 7A and 7B.

Second Exemplary Embodiment

Figure 9:
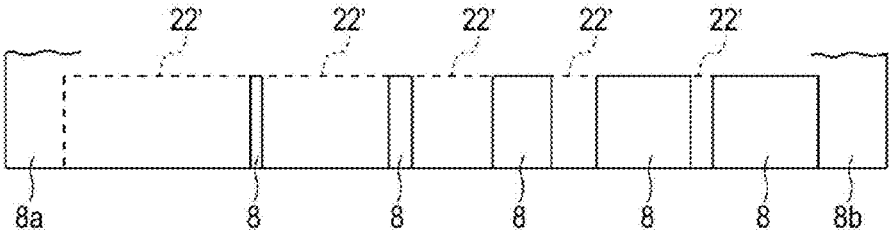
FIG. 9 is a diagram for explaining a partition member according to a second exemplary embodiment and is a diagram corresponding to FIG. 6, which shows the partition member according to the first exemplary embodiment.

FIG. 9 is a diagram for explaining a partition member according to a second exemplary embodiment and is a diagram corresponding to FIG. 6, which shows the partition member according to the first exemplary embodiment.

In the following description of the second exemplary embodiment of the present invention, the components corresponding to those in the first exemplary embodiment will be denoted by the same reference numerals, and a detailed description thereof will be omitted.

The second exemplary embodiment have the same configuration as the first exemplary embodiment, except for the following configuration.

In FIG. 9, in the developing device Gy according to the second exemplary embodiment, multiple by-pass portions 22' are provided at intervals that increase toward the downstream side in the developer-transport direction in the admix chamber 7. The by-pass portions 22' according to the second exemplary embodiment gradually increase in width toward the downstream side, and the intervals therebetween are gradually reduced toward the downstream side. Hence, the amount of developer moving between the admix chamber 7 and the supply chamber 6 increases toward the downstream side. Furthermore, the by-pass portions 22' are formed on an even upstream side of the by-pass portion 22 according to the first exemplary embodiment.

Advantages of the Second Exemplary Embodiment

In the thus-configured developing device Gy according to the second exemplary embodiment, it is possible to move the developer between the admix chamber 7 and the supply chamber 6 on the upstream side in the developer-transport direction in the admix chamber 7, compared with the first exemplary embodiment. Furthermore, the developing device Gy according to the second exemplary embodiment has the same advantages as those according to the first exemplary embodiment.

Third Exemplary Embodiment

Figure 10:
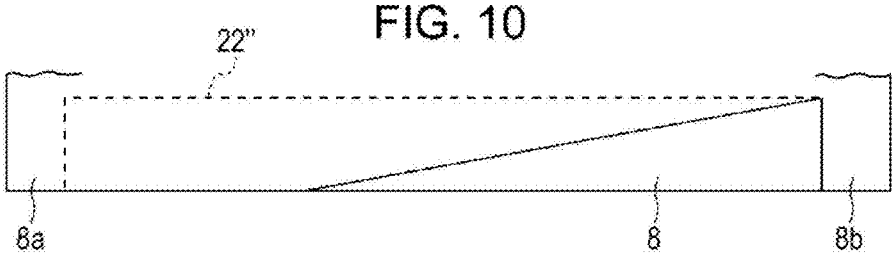
FIG. 10 is a diagram for explaining a partition member according to a third exemplary embodiment and is a diagram corresponding to FIG. 6, which shows the partition member according to the first exemplary embodiment.

FIG. 10 is a diagram for explaining a partition member according to a third exemplary embodiment and is a diagram corresponding to FIG. 6, which shows the partition member according to the first exemplary embodiment.

In the following description of the third exemplary embodiment of the present invention, the components corresponding to those in the first exemplary embodiment will be denoted by the same reference numerals, and a detailed description thereof will be omitted.

The third exemplary embodiment have the same configuration as the first exemplary embodiment, except for the following configuration.

In FIG. 10, in the developing device Gy according to the third exemplary embodiment, the partition wall 8 is gradually reduced in height toward the downstream side in the developer-transport direction in the admix chamber 7, thus providing a by-pass portion 22". The rear end of the partition wall 8 is located at three-fourth of the length of the developing width 21. Hence, in the by-pass portion 22" according to the third exemplary embodiment, the area from which the developer flows into the supply chamber 6 increases toward the downstream side in the admix chamber 7.

Advantages of the Third Exemplary Embodiment

In the thus-configured developing device Gy according to the third exemplary embodiment, when the height of the developer is high due to a large amount of developer being returned from the developing roller R0*y*, the developer flows into the supply chamber 6 also on the upstream side in the admix chamber 7. Thus, it is possible to prevent the amount of developer in the admix chamber 7 from becoming unevenly large. Furthermore, the developing device Gy according to the third exemplary embodiment has the same advantages as those according to the first exemplary embodiment.

Modification Example

Although the exemplary embodiments of the present invention have been described in detail above, the present invention is not limited to such exemplary embodiments, and they may be variously modified within a scope not departing from a spirit of the present invention. Modification examples (H01) to (H05) of the present invention will be described below.

(H01)

In the above-described exemplary embodiments, a copier is shown as an example of the image forming apparatus. However, the image forming apparatus is not limited to the copier, but may be, for example, a printer, a facsimile, or a multi-function machine having some of or all of these functions.

(H02)

In the exemplary embodiment, the copier U uses four color developers. However, the copier U may be applicable to, for example, a single-color image forming apparatus or a multi-color image forming apparatus that uses more than four colors or less than four colors.

(H03)

The specific numerals or values given in the above-described exemplary embodiments may be modified according to the design and specification.

(H04)

The shape, position, and size of the guide wall 23 described in the above-described exemplary embodiments may be modified according to the design and specification. For example, in one possible configuration, the length of the guide member is reduced at the front end, thereby enabling the toner to be returned to the admix chamber at a portion where the by-pass portion is formed and enabling the toner to be returned to the supply chamber at a portion near the supply port.

(H05)

In the third exemplary embodiment, the configuration in which the height of the upper end of the partition wall 8 gradually decreases toward the downstream side is shown. However, it is also possible that, for example, the height of the lower end of the partition wall gradually increases toward the downstream side, that is, the by-pass portion 22" shown in FIG. 10 is reversed in the vertical direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer container that stores developer;

a developer carrier disposed in the developer container, the developer carrier being rotated, with the developer carried on a surface thereof, and facing an image carrier on which a latent image is formed;

a first transport member that has a rotation shaft and a transport blade supported by the rotation shaft, the first transport member transporting the developer in the developer container while admixing the developer;

a second transport member that has a rotation shaft and a transport blade supported by the rotation shaft, the second transport member being disposed parallel to the first transport member, the second transport member transporting the developer, while admixing the developer, in a direction opposite to a direction in which the first transport member transports the developer;

a partition member disposed between the first transport member and the second transport member so as to partition a space inside the developer container into a first storage chamber where the first transport member is disposed and a second storage chamber where the second transport member is disposed;

a guide member that guides the developer detached from the developer carrier toward the second storage chamber;

a first inflow portion formed at a downstream end in the direction in which the first transport member transports the developer, the first inflow portion allowing the developer to flow from the first storage chamber toward the second storage chamber;

a second inflow portion formed at a downstream end in a direction in which the second transport member transports the developer, the second inflow portion allowing the developer to flow from the second storage chamber toward the first storage chamber; and a movement portion provided in the partition member, at a position on an upstream side of the second inflow portion in the direction in which the second transport member transports the developer, the movement portion allowing the developer to move between the second storage chamber and the first storage chamber, wherein the rotation shaft of the first transport member is located within a projection area of the developer carrier projected from above in a gravity direction, wherein, assuming that there is a first imaginary tangent line extending in the gravity direction and touching an outer surface of the developer carrier, on the opposite side of the developer carrier from the image carrier, and that there is a second imaginary tangent line extending in the gravity direction and touching an outer end of the transport blade of the first transport member, on the opposite side of the first transport member from the image carrier, the second imaginary tangent line is located farther from the image carrier than the first imaginary tangent line in a horizontal direction, wherein, assuming that a distance between the first imaginary tangent line and the second imaginary tangent line in the horizontal direction is a first distance and that a distance between a surface of the developer carrier and an inner surface of the developer container on a horizontal line extending from a rotation center of the developer carrier in the horizontal direction, on the opposite side of the developer carrier from the image carrier, is a second distance, the first distance is smaller than the second distance, and wherein the movement portion has a length at least one-fourth of a developing width.

2. The developing device according to claim 1, wherein the movement portion includes a plurality of movement portions that are provided at intervals along the direction in which the second transport member transports the developer.

3. A developing device comprising:

a developer carrier disposed in the developer container, the developer carrier being rotated, with the developer carried on a surface thereof, and facing an image carrier on which a latent image is formed;

a first transport member that has a rotation shaft and a transport blade supported by the rotation shaft, the first transport member transporting the developer in the developer container while admixing the developer;

a second transport member that has a rotation shaft and a transport blade supported by the rotation shaft, the second transport member being disposed parallel to the first transport member, the second transport member transporting the developer, while admixing the developer, in a direction opposite to a direction in which the first transport member transports the developer;

a partition member disposed between the first transport member and the second transport member so as to partition a space inside the developer container into a first storage chamber where the first transport member is disposed and a second storage chamber where the second transport member is disposed;

a guide member that guides the developer detached from the developer carrier toward the second storage chamber;

a first inflow portion formed at a downstream end in the direction in which the first transport member transports the developer, the first inflow portion allowing the developer to flow from the first storage chamber toward the second storage chamber;

a second inflow portion formed at a downstream end in a direction in which the second transport member transports the developer, the second inflow portion allowing the developer to flow from the second storage chamber toward the first storage chamber; and a movement portion provided in the partition member, at a position on an upstream side of the second inflow portion in the direction in which the second transport member transports the developer, the movement portion allowing the developer to move between the second storage chamber and the first storage chamber, wherein the rotation shaft of the first transport member is located within a projection area of the developer carrier projected from above in a gravity direction, wherein, assuming that there is a first imaginary tangent line extending in the gravity direction and touching an outer surface of the developer carrier, on the opposite side of the developer carrier from the image carrier, and that there is a second imaginary tangent line extending in the gravity direction and touching an outer end of the transport blade of the first transport member, on the opposite side of the first transport member from the image carrier, the second imaginary tangent line is located farther from the image carrier than the first imaginary tangent line in a horizontal direction, wherein, assuming that a distance between the first imaginary tangent line and the second imaginary tangent line in the horizontal direction is a first distance and that a distance between a surface of the developer carrier and an inner surface of the developer container on a horizontal line extending from a rotation center of the developer carrier in the horizontal direction, on the opposite side of the developer carrier from the image carrier, is a second distance, the first distance is smaller than the second distance, and wherein the movement portion is designed such that an area from which the developer flows in increases toward the downstream side in the direction in which the second transport member transports the developer.

4. A developing device comprising:

a developer container that stores developer;

a developer carrier disposed in the developer container, the developer carrier being rotated, with the developer carried on a surface thereof, and facing an image carrier on which a latent image is formed;

a first transport member that has a rotation shaft and a transport blade supported by the rotation shaft, the first transport member transporting the developer in the developer container while admixing the developer;

a second transport member that has a rotation shaft and a transport blade supported by the rotation shaft, the second transport member being disposed parallel to the first transport member, the second transport member transporting the developer, while admixing the developer, in a direction opposite to a direction in which the first transport member transports the developer;

a partition member disposed between the first transport member and the second transport member so as to partition a space inside the developer container into a first storage chamber where the first transport member is disposed and a second storage chamber where the second transport member is disposed;

a guide member that guides the developer detached from the developer carrier toward the second storage chamber;

a first inflow portion formed at a downstream end in the direction in which the first transport member transports the developer, the first inflow portion allowing the developer to flow from the first storage chamber toward the second storage chamber; and a second inflow portion formed at a downstream end in a direction in which the second transport member transports the developer, the second inflow portion allowing the developer to flow from the second storage chamber toward the first storage chamber, wherein the rotation shaft of the first transport member is located within a projection area of the developer carrier projected from above in a gravity direction, wherein, assuming that there is a first imaginary tangent line extending in the gravity direction and touching an outer surface of the developer carrier, on the opposite side of the developer carrier from the image carrier, and that there is a second imaginary tangent line extending in the gravity direction and touching an outer end of the transport blade of the first transport member, on the opposite side of the first transport member from the image carrier, the second imaginary tangent line is located farther from the image carrier than the first imaginary tangent line in a horizontal direction, wherein, assuming that a distance between the first imaginary tangent line and the second imaginary tangent line in the horizontal direction is a first distance and that a distance between a surface of the developer carrier and an inner surface of the developer container on a horizontal line extending from a rotation center of the developer carrier in the horizontal direction, on the opposite side of the developer carrier from the image carrier, is a second distance, the first distance is smaller than the second distance, wherein the developer is movable between the second storage chamber and the first storage chamber on the upstream side of the second inflow portion in the direction in which the second transport member transports the developer, and wherein the developer is movable in an area that has a length at least one-fourth of a developing width.

5. The developing device according to claim 4, wherein the partition member extends in a longitudinal direction of the first storage chamber and is disposed between the first inflow portion and a one-half length portion of the first storage chamber.

6. An image forming apparatus comprising:

an image carrier;

a latent-image forming device that forms a latent image on a surface of the image carrier;

the developing device according to claim 1, the developing device developing the latent image on the surface of the image carrier into a visible image;

a transfer device that transfers the visible image on the surface of the image carrier to a medium; and a fixing device that fixes the visible image onto the surface of the medium.

* * * * *